US008247980B2

(12) United States Patent
Lee et al.

(10) Patent No.: US 8,247,980 B2
(45) Date of Patent: Aug. 21, 2012

(54) LED DRIVING CIRCUIT AND LIGHT EMITTING DIODE ARRAY DEVICE

(75) Inventors: Young Jin Lee, Seoul (KR); Joong Kon Son, Seoul (KR); Hyung Kun Kim, Gyunggi-do (KR); Jung Ja Yang, Gyunggi-do (KR); Grigory Onushkin, Gyunggi-do (KR)

(73) Assignee: Samsung LED Co., Ltd., Gyungg-do (KR)

( * ) Notice: Subject to any disclaimer, the term of this patent is extended or adjusted under 35 U.S.C. 154(b) by 751 days.

(21) Appl. No.: 12/262,801

(22) Filed: Oct. 31, 2008

(65) Prior Publication Data

US 2009/0322248 A1 Dec. 31, 2009

(30) Foreign Application Priority Data

Jun. 30, 2008 (KR) ..... 10-2008-0063128

(51) Int. Cl.
*F21S 4/00* (2006.01)
*H05B 37/00* (2006.01)
*F21V 33/00* (2006.01)

(52) U.S. Cl. ..... 315/185 S; 315/187; 315/200 A; 315/312; 315/326; 362/800; 362/812; 362/85; 362/86; 362/95

(58) Field of Classification Search ..... 315/185 S, 315/187, 200 A, 312–326; 362/800–812, 362/85–86, 95

See application file for complete search history.

(56) References Cited

U.S. PATENT DOCUMENTS

| | | | | |
|---|---|---|---|---|
| 5,467,049 | A * | 11/1995 | Kida et al. | 327/438 |
| 7,138,770 | B2 | 11/2006 | Uang et al. | |
| 8,026,675 | B2 * | 9/2011 | Lee et al. | 315/291 |
| 2006/0138971 | A1 | 6/2006 | Uang et al. | |
| 2009/0174337 | A1 * | 7/2009 | Miskin et al. | 315/250 |
| 2009/0322241 | A1 * | 12/2009 | Onushkin et al. | 315/250 |

FOREIGN PATENT DOCUMENTS

| | | | |
|---|---|---|---|
| JP | 2004-006582 | | 1/2004 |
| KR | 10-2006-0020572 | A | 3/2006 |
| WO | WO 2004/023568 | A1 | 3/2004 |

* cited by examiner

*Primary Examiner* — Jason M Crawford
(74) *Attorney, Agent, or Firm* — McDermott Will & Emery LLP

(57) ABSTRACT

There is provided an LED driving circuit. The LED driving circuit according to an aspect of the invention may include: at least one ladder circuit including: (n−1) number (here, n is a positive integer satisfying n≧2) of first branches provided between first and second junction points, and connected in-line with each other by n number of first middle junction points, (n−1) number of second branches arranged in parallel with the first branches, and connected in-line with each other by n number of second middle junction points between the first and second junction points, and n number of middle branches connecting m-th first and second middle junction points to each other, wherein at least one LED device is disposed on each of the first, second, and middle branches. Here, the number of LED devices included in each of the first and second branches is greater than the number of LED devices included in each of the middle branches.

4 Claims, 7 Drawing Sheets

LED DRIVING CIRCUIT AND LIGHT EMITTING DIODE ARRAY DEVICE

CROSS-REFERENCE TO RELATED APPLICATIONS

This application claims the priority of Korean Patent Application No. 2008-0063128 filed on Jun. 30, 2008, in the Korean Intellectual Property Office, the disclosure of which is incorporated herein by reference.

BACKGROUND OF THE INVENTION

1. Field of the Invention

The present invention relates to LED driving circuits, and more particularly, to an LED driving circuit and an LED array device that can be directly used with AC power without using a conversion apparatus converting the AC power into DC power.

2. Description of the Related Art

Semiconductor light emitting diodes (LEDs) have advantages as light sources in terms of output, efficiency, and reliability. The research and development of the semiconductor LEDs that replace backlights of lighting apparatus or display devices as high-power and high-efficiency light sources has been actively conducted.

In general, light emitting diodes are driven at a low DC voltage. Therefore, an additional circuit (for example, an AD/DC converter) that supplies a low DC output voltage is required to drive a light emitting diode at normal voltage (AC 220V). However, the introduction of the additional circuit may not only complicate the configuration of an LED module, but also reduce the efficiency and reliability during a process of converting supply power. Further, an additional component except for a light source increases manufacturing costs and product size, and EMI characteristics are deteriorated due to periodic components during a switching-mode operation.

In order to solve this problem, various types of LED driving circuits that can be driven at an AC voltage without using an additional converter have been proposed. However, most of the LEDs are arranged so that they may be only driven in a predetermined half cycle of an AC voltage. This means the number of LEDs is increased in order to produce a desired amount of light.

The number of LEDs may vary according to the arrangement of the LEDs even when the same amount of light is supplied. The arrangement of LEDS according to the related art has very low efficiency. For example, when LEDs are connected in a reverse-parallel arrangement or a bridge arrangement, which is a representative arrangement in the related art, only 50% or 60% of the total number of LEDs actually emit light continuously. That is, the number of LEDs used is increased to obtain a desired level of emission, which reduces the efficiency.

Therefore, chip efficiency is required so that a smaller number of LEDS are used to produce the same amount of light by efficiently arranging the LEDs. In terms of economic efficiency, the chip efficiency is a very important consideration in the manufacture and sale of AC-driven LED circuits.

However, the chip efficiency is contrary to the reliability with respect to a reverse voltage. In general, the higher the chip efficiency is, the greater the reverse voltage is applied to LEDs in a half cycle during which the LEDs are not driven. The LED is vulnerable to the reverse voltage.

In particular, in a case of the LEDs that are essentially sensitive to ESD, the problem of the reverse voltage becomes even more significant. This needs to be carefully considered as well in order to increase manufacturing yield and ensure the use of commercial power is safe.

SUMMARY OF THE INVENTION

An aspect of the present invention provides an AC-driven LED driving circuit that generates a desired output with a reduced number of LED devices, and has improved ESD characteristics.

According to an aspect of the present invention, there is provided an LED driving circuit including: at least one ladder circuit including: (n−1) number (here, n is a positive integer satisfying $n \geqq 2$) of first branches provided between first and second junction points, and connected in-line with each other by n number of first middle junction points, (n−1) number of second branches arranged in parallel with the first branches, and connected in-line with each other by n number of second middle junction points between the first and second junction points, and n number of middle branches connecting m-th first and second middle junction points to each other, wherein at least one LED device is disposed on each of the first, second, and middle branches, and m is a positive integer defining respective sequences of the (n−1) number of first branches, the (n−1) number second branches, and the n number of middle branches from the first junction point; a first current loop having a first group of LED devices located on a sequence of 2m first branches, a sequence of (2m−1) second branches, and the n number of middle branches, respectively to be connected in series with each other and driven in a first half cycle of an alternating voltage applied between the first and second junction points; and a second current loop having a second group of LED devices located on a sequence of (2m−1) first branches, a sequence of 2m second branches, and the n number of middle branches, respectively to be connected in series with each other and driven in a second half cycle of the alternating voltage between the first and second junction points, wherein the number of LED devices included in each of the first and second branches is greater than the number of LED devices included in each of the middle branches.

Two LEDs may be included in each of the first and second branches, and one LED device may be included in each of the middle branches.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
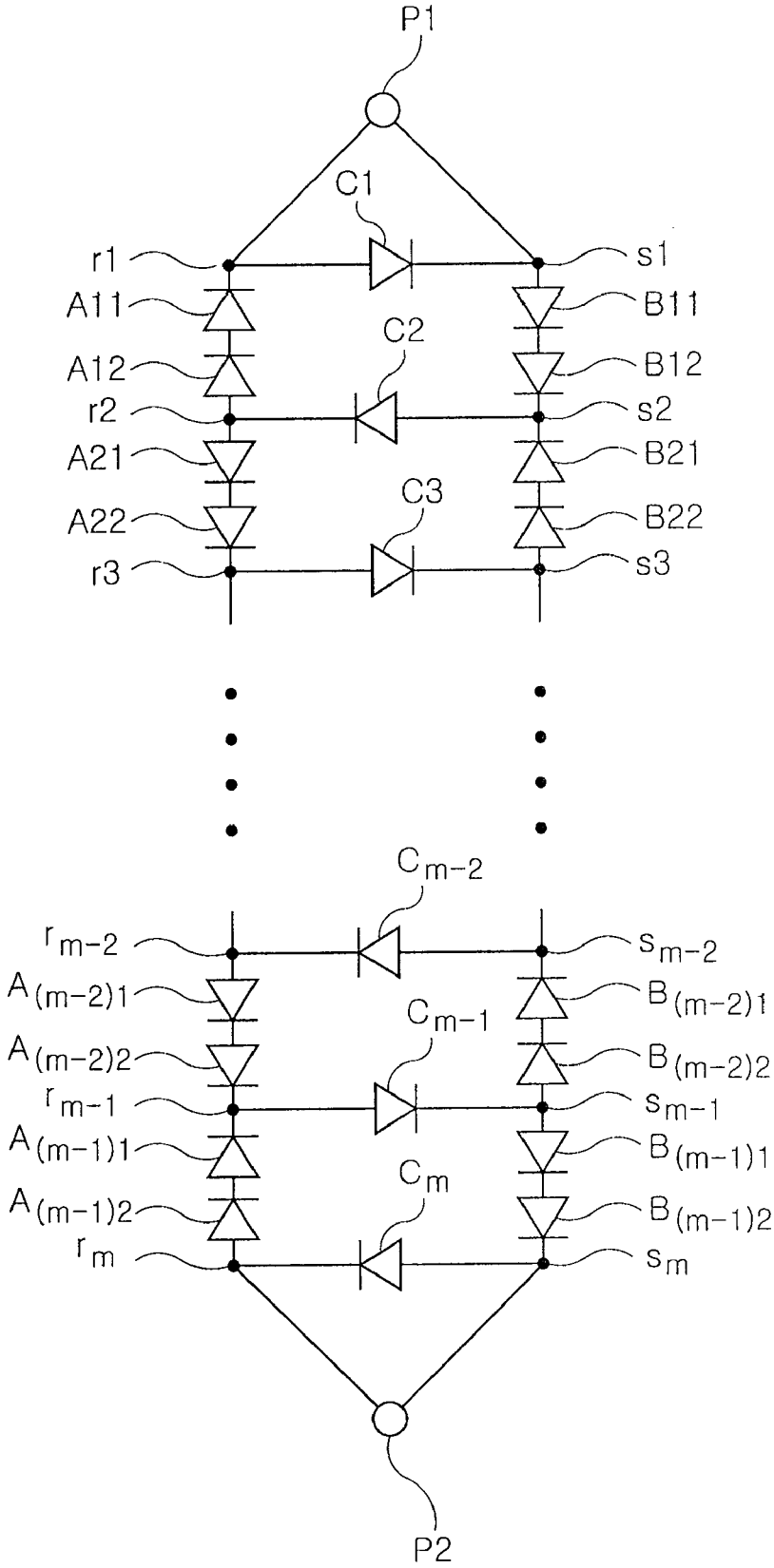
FIG. 1 is a view illustrating an LED driving circuit according to an exemplary embodiment of the invention.

FIG. 1 is a view illustrating an LED driving circuit according to an exemplary embodiment of the invention.

An AC-driven driving circuit according to an exemplary embodiment includes a ladder network LED circuit.

The ladder network LED circuit includes (n−1) number of first branches and (n−1) number of second branches. The (n−1) number of first branches are connected in-line by n number first middle junction points $r_1, r_2, r_3, \ldots r_{m-2}, r_{m-1}$, and $r_m$, and located between first and second junction points P1 and P2. The (n−1) number of second branches are located between the first and second junction points P1 and P2, formed in parallel with the (n−1) number of first branches, and connected in-line by n number of second middle junction points $s_1, s_2, s_3, \ldots s_{m-2}, s_{m-1}$, and $s_m$. Here, n is an integer of 2 or more. In this embodiment, m may also be used.

The LED driving circuit includes n number of middle branches that are sequentially connected between the first and second middle junction points ($r_1$ and $s_1$, $r_2$ and $s_2$, $r_3$ and $s_3, \ldots r_{m-2}$ and $s_{m-2}$, $r_{m-1}$ and $s_{m-1}$, and $r_m$ and $s_m$) from the first junction point P1 (or the second junction point).

Each of the first branches, the second branches, and the middle branches, includes at least one LED device.

The LED devices included in the respective branches are arranged to form first and second current loops that are driven in different half cycles of an alternating voltage. That is, in a first half cycle of the alternating voltage, the LED devices in a first group are arranged in series with each other to form the first current loop along $C_1$-$B_{11}$-$B_{12}$-$C_2$-$A_{21}$-$A_{22}$-$C_3$- . . . -$C_{(m-2)}$-$A_{(m-2)1}$-$A_{(m-2)2}$-$C_{(m-1)}$-$B_{(m-1)1}$-$B_{(m-1)2}$-$C_m$.

The LED devices in a second group are arranged in series with each other to form the second current loop along $C_1$-$A_{11}$-$A_{12}$-$C_2$-$B_{21}$-$B_{22}$-$C_3$- . . . -$C_{(m-2)}$-$B_{(m-2)1}$-$B_{(m-2)2}$-$C_{(m-1)}$-$A_{(m-1)1}$-$A_{(m-1)2}$-$C_m$ in a second half cycle of the alternating voltage. Here, the second current loop is in reverse direction to the first current loop.

The LEDs are arranged in the ladder network circuit as described below when the first and second branches and middle branches from the first junction point have respective sequences defined by m.

The LED devices in the first group forming the first current loop include LED devices corresponding to a sequence of (2m−1) (odd numbered) second branches, all of the middle branches, and a sequence of 2m (even numbered) first branches. The LED devices in the first current loop are connected in series with each other. The LED devices in the second group forming the second current loop include LED devices corresponding to a sequence of (2m−1) (odd numbered) first branches, all of the middle branches, and 2m (even numbered) second branches. The LED devices in the second group are connected in series with each other and are reverse in polarity to the LED devices of the first group.

In the LED driving circuit according to this embodiment, the m number of LED devices $C_1, C_2, C_3, \ldots C_{(m-2)}, C_{(m-1)}$, and $C_m$ located on the middle branches are shared by the first and second current loops. Therefore, the m number of LED devices $C_1, C_2, C_3, \ldots C_{(m-2)}, C_{(m-1)}$, and $C_m$ are continuously driven for the entire cycle of the alternating voltage.

That is, since the LED devices located on the middle branches are continuously driven for the entire cycle of the alternating voltage, a ratio of the LED devices, which continuously emit light in the actual ladder network circuit, to the entire LED devices used is approximately 62.5%.

This figure is higher than that of the AC-driven LED arrangement, for example, a ratio (50%) of a reverse polarity arrangement or a ratio (generally, 60%) of a bridge arrangement.

Therefore, the increase in number of LED devices of the middle branches may positively affect the chip efficiency, but at the same time, may adversely affect ESD characteristics.

In order to solve this problem, in the embodiment of the invention, the number of LED devices $A_{11}, A_{12} \ldots A_{(m-1)1}$, and $A_{(m-1)2}$ and $B_{11}, B_{12} \ldots B_{(m-1)1}$, and $B_{(m-1)2}$ that belong to the first and second branches, respectively, is greater than the number of LED devices $C_1, C_2 \ldots C_{(m-1)}, C_m$ that belong to the middle branches. Preferably, the number of LED devices disposed on each of the first and second branch is twice as many as the number of LED devices disposed on the middle branch.

As shown in FIG. 1, two LED devices are arranged on each of the first and second LED devices, and one LED device is arranged on the middle branch.

The ESD characteristics can be improved through the arrangement of the LED devices. This will be described in more detail with reference to FIGS. 2 and 3.

Though not shown in the circuit of FIG. 1, LED devices may be additionally disposed between the first junction point, and the first and second middle junction points in accordance to the polarities of the first and second current loops. Similarly, LED devices may be additionally disposed between the second junction point and the m-th first and second middle junction points.

Figure 2A:
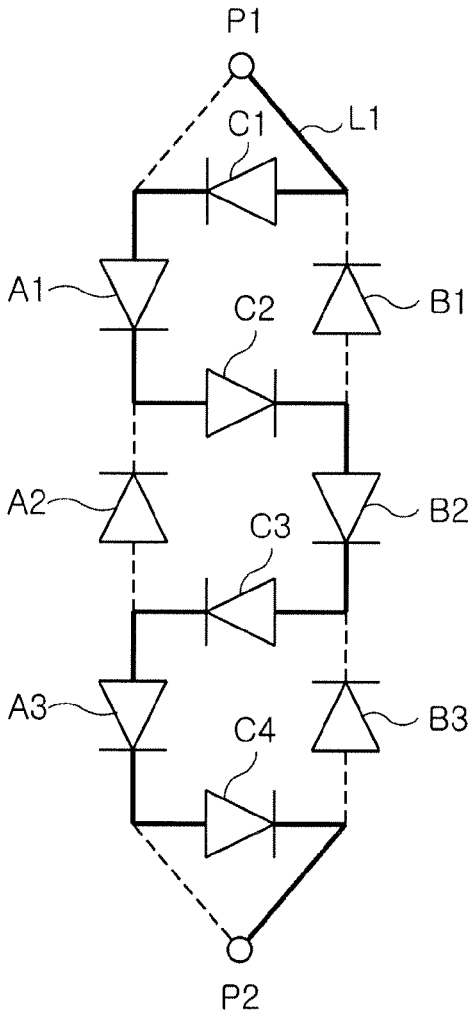
PRIOR ART FIG. 2A
FIG. 2A is a circuit diagram illustrating a reverse voltage applied to one LED when a ladder LED driving circuit according to the related art is driven.
Figure 2B:
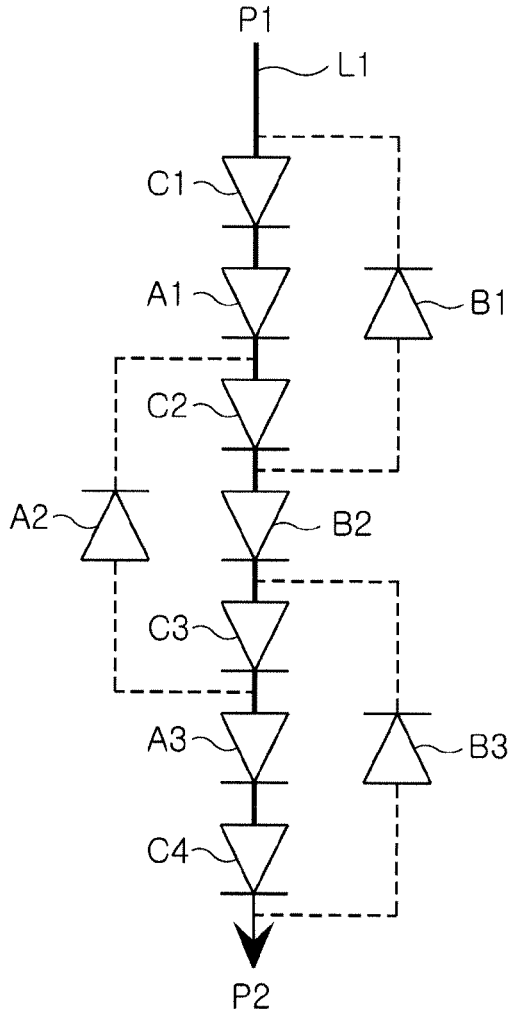
PRIOR ART FIG. 2B
FIG. 2B is a circuit diagram illustrating a reverse voltage applied to one LED when a ladder LED driving circuit according to the related art is driven.
Figure 3A:
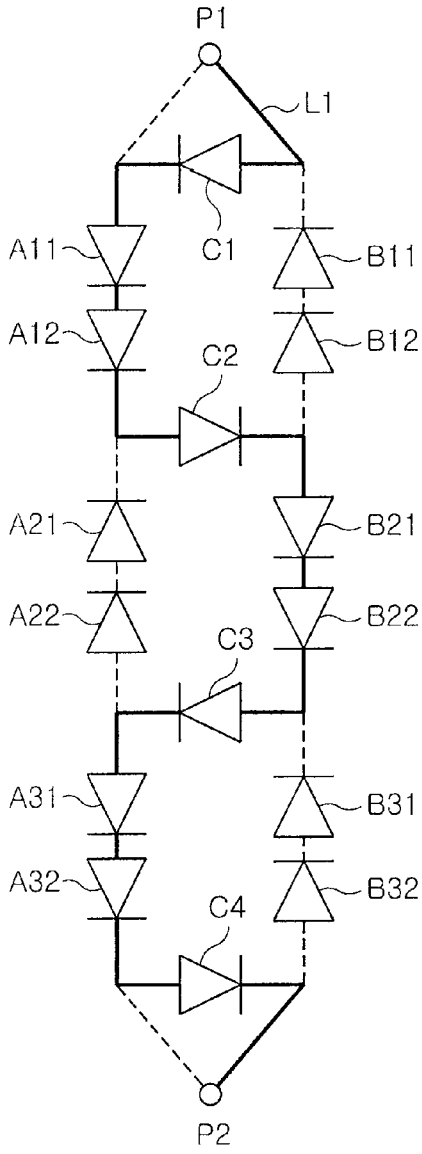
FIG. 3A is a circuit diagram illustrating a reverse voltage applied to one LED when a ladder LED driving circuit is driven according to an exemplary embodiment of the invention.
Figure 3B:
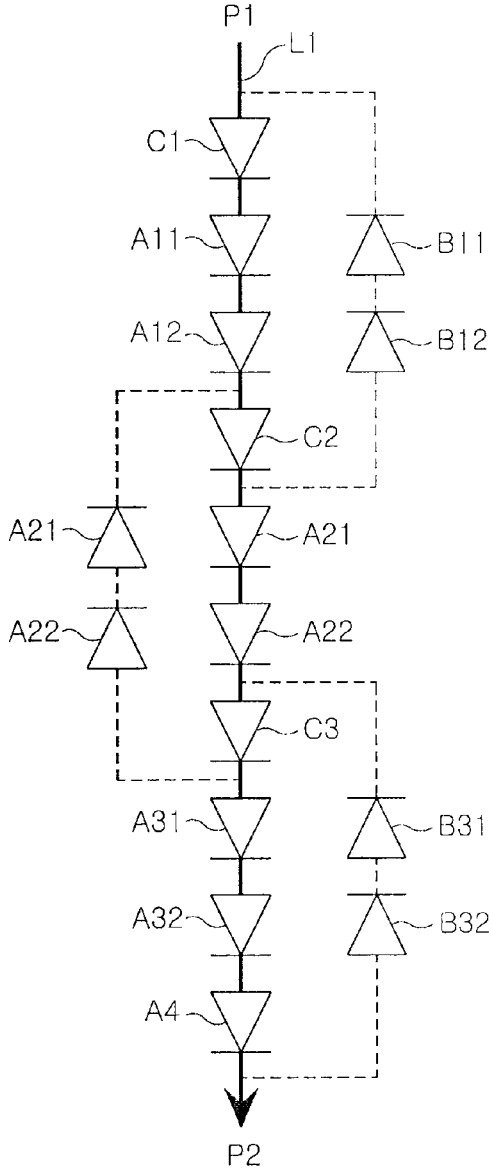
FIG. 3B is a circuit diagram illustrating a reverse voltage applied to one LED in a ladder LED driving circuit according to the exemplary embodiment of FIG. 3A.

FIGS. 2A and 2B are circuit diagrams illustrating a reverse voltage applied to one LED when a ladder LED driving circuit according to the related art is driven. FIGS. 3A and 3B are circuit diagrams illustrating a reverse voltage applied to one LED when a ladder network LED driving circuit according to an exemplary embodiment of the invention is driven.

First, as shown in FIG. 2A, when the LED devices $C_1$-$A_1$-$C_2$-$B_2$-$C_3$-$A_3$-$C_4$ of the first group are driven along the first current loop L1 in a predetermined half cycle, a reverse voltage is applied to the LED devices $B_1$, $A_2$, and $B_3$ that are not driven.

This will be more easily understood with reference to FIG. 2B that is a reconfiguration of the circuit diagram of FIG. 2A.

As shown in FIG. 2B, a ratio of the number of LED devices (for example, $B_1$) that are not driven in the first current loop L1, that is, the number of LED devices to which a reverse voltage is applied, to the number of LED devices (for example, $C_1$, $A_1$, and $C_2$) to which a forward voltage is applied is 1:3.

The LED device used in the LED driving circuit according to this embodiment needs to have reverse voltage characteristics to withstand a reverse voltage that is at least three times as much as an operating limit voltage.

On the contrary, when the number of LEDs is controlled according to the location of each of the branches according to the embodiment of the invention, the reverse voltage characteristics can be improved.

As shown in FIG. 3A, when the LED devices $C_1$-$A_{11}$-$A_{12}$-$C_2$-$B_{21}$-$B_{22}$-$C_3$-$A_{31}$-$A_{31}$-$C_4$ in the first group are driven along the first current loop L1, a reverse voltage is applied to the LED devices $B_{11}$, $B_{12}$, $A_{21}$, $A_{22}$, $B_{31}$, and $B_{32}$ that are not driven.

Referring to FIG. 3B that is a reconfiguration of the circuit diagram of FIG. 3A, a ratio of the number of LED devices, which are not driven in the first current loop L1, that is, the number of LED devices ($B_{11}$ and $B_{12}$) applied with the reverse voltage to the number of LED devices ($C_1$-$A_{11}$-$A_{12}$-$C_2$) applied with the forward voltage is 2:4, that is, 1:2.

Therefore, the LED device used in the LED driving circuit according to this embodiment of the invention needs to have reverse voltage characteristics to withstand a reverse voltage that is at least twice as much as an operating limit voltage.

With the use of the circuit shown in FIG. 3A, a ratio of 1:2 that is lower than the ratio of 1:3 in a case of the circuit, shown in FIG. 2A, can be obtained. That is, according to this embodiment, the reverse voltage characteristics can be increased by 1.5 times as compared with the related art.

For example, when the general circuit, shown in FIG. 2A, has a limit value of 2000 V, the circuit, shown in FIG. 3A, has a limit value as large as 3000 V.

Therefore, the circuit, shown in FIG. 3, can be expected to have excellent ESD characteristics or excellent characteristics in electric tests such as an impulse noise test. An apparatus using the LED driving circuit according to this embodiment can also be expected to obtain excellent characteristics, and manufacturing yield can be increased in the manufacturing process.

FIG. 4 is a view illustrating a current loop when a ladder network LED driving circuit performs a normal operation according to the related art. FIGS. 5A and 5B are views illustrating a change in the current loop when one LED breaks down in the ladder LED driving circuit, shown in FIG. 4.

As a comparison, FIG. 6 is a view illustrating current loops in a ladder network LED driving circuit that operates normally according to another exemplary embodiment of the invention. FIG. 7 is a view illustrating a change in the current loops when one LED breaks down in the ladder network LED driving circuit, shown in FIG. 6.

Figure 4A:
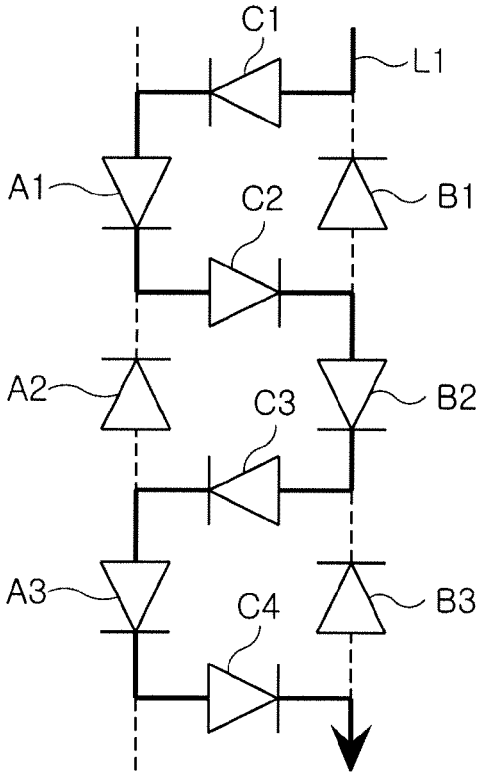
PRIOR ART FIG. 4A
FIGS. 4A and 4B are views illustrating a current loop when the ladder LED driving circuit according to the related art performs a normal operation.
Figure 4B:
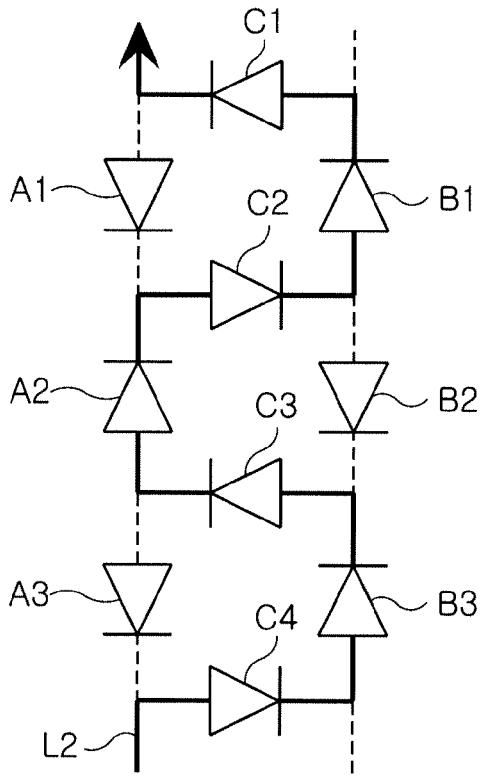
PRIOR ART FIG. 4B
Figure 5A:
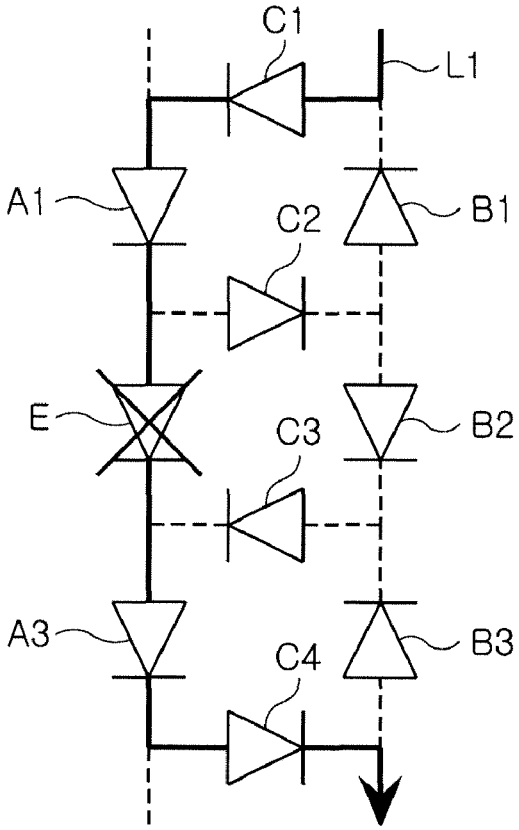
PRIOR ART FIG. 5A
FIG. 5A is a view illustrating a change in the current loop when one LED breaks down in the ladder LED driving circuit, shown in FIG. 4A.
Figure 5B:
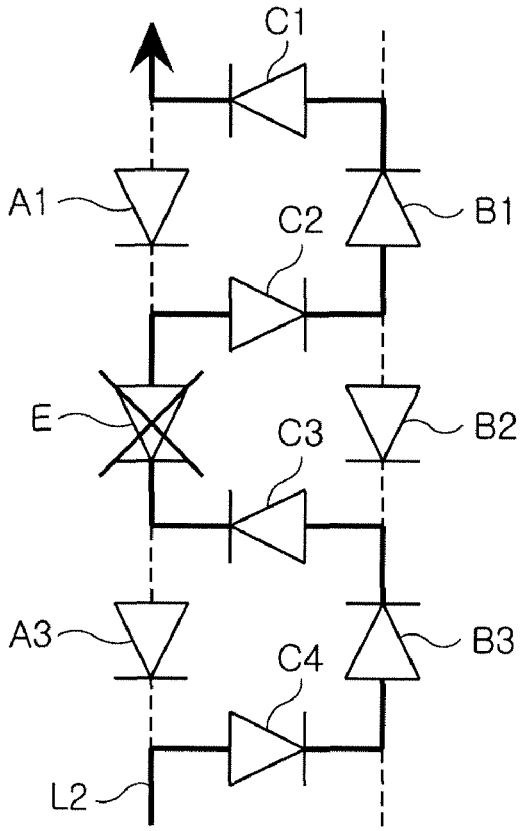
PRIOR ART FIG. 5B
FIG. 5B is a view illustrating a change in the current loop when one LED breaks down in the ladder LED driving circuit, shown in FIG. 4B.

In FIGS. 4A and 4B, current loops L1 and L2 are shown in half cycles of the alternating voltage while the LED driving circuit having reverse voltage characteristics with a ratio of 1:3 performs a normal operation.

For example, 75 LEDs that are connected in series with each other are turned on in each direction. However, if an LED device E located on one branch is defective and short-circuited, the driving state of the LEDs is changed.

That is, due to the short circuit of the LED device E, the three LED devices $C_2$, $B_2$, and $C_3$ do not emit light in the forward current loop (refer to L1 of FIG. 5A), and one defective LED device E does not emit light in the reverse current loop (refer to L2 of FIG. 5B).

Therefore, when there is no defect (FIGS. 4A and 4B), the 75 LEDs emit light in a bi-direction on average. If one LED is defective, the average LED emitting light is 73, and the standard deviation is 1.4. Therefore, an imbalance is created between the left and right.

When 2 LED devices are defective, the average LED emitting light is 71, and the standard deviation is 2.8 in a bi-direction. When 3 LED devices are defective, the average is 69, and the standard deviation is 4.2. Therefore, a chip error rate becomes higher due to the defects of the LEDs (refer to Table 1 below).

Figure 6A:
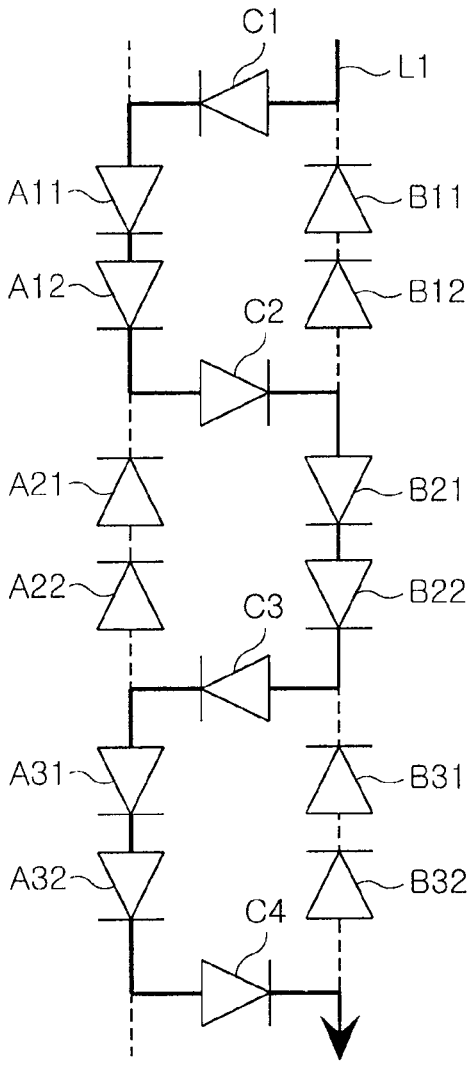
FIGS. 6A and 6B is views illustrating a current loop when the LED driving circuit according to the exemplary embodiment of the invention performs a normal operation.
Figure 6B:
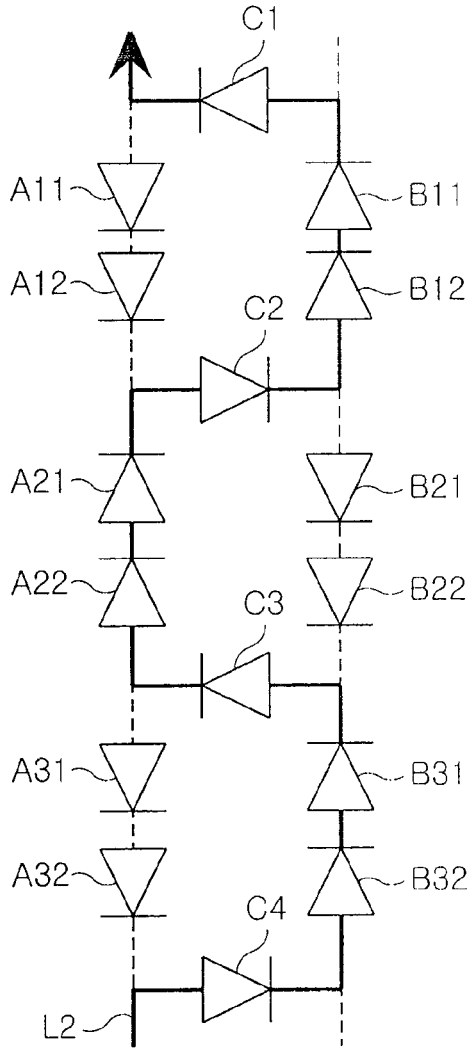

On the contrary, when the circuit according to this embodiment operates normally, the same numbers of LEDs emit light in the forward current loop L1 and the reverse current loop L2 as shown in FIGS. 6A and 6B.

Figure 7A:
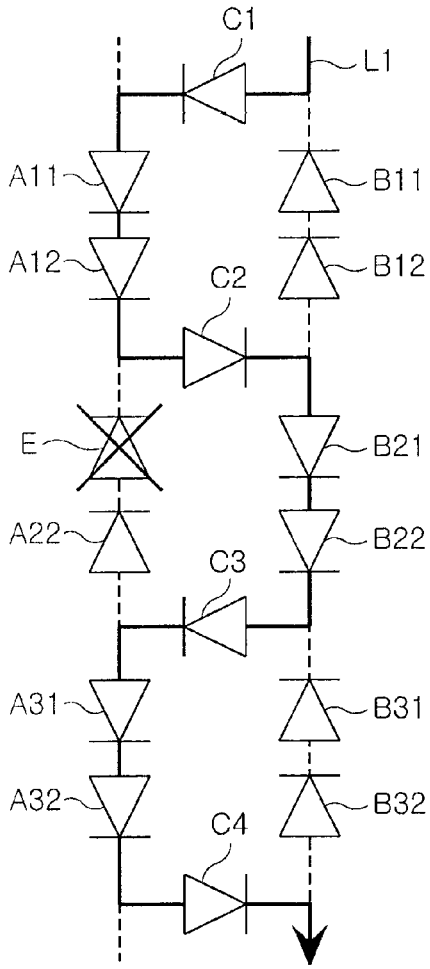
FIG. 7A is a view illustrating a change in the current loop when one LED breaks down in the ladder LED driving circuit, shown in FIG. 6A.
Figure 7B:
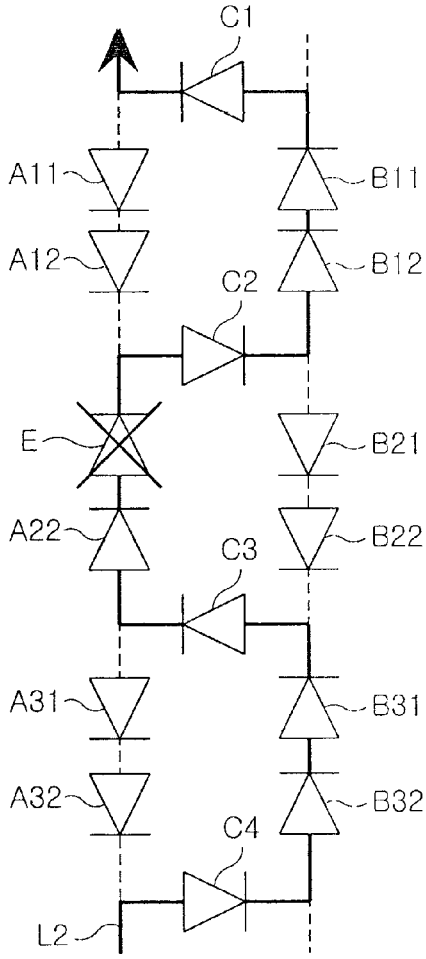
FIG. 7B is a view illustrating a change in the current loop when one LED breaks down in the ladder LED driving circuit, shown in FIG. 6B.

For example, when 72 LED devices are driven in each of the forward and reverse current loops L1 and L2, if 1 LED device E is defective and short-circuited, the LED devices are driven in the forward current loop L1, as shown in FIG. 7A, which is not different from the normal operation of FIG. 6A. As shown in FIG. 7B, only the one defective LED device E does not emit light in the reverse current loop L2. Here, as shown in Table 1, the average is 71.5, and the standard deviation of 0.7.

When 2 LED devices are defective, the average LED device emitting light is 71, and the standard deviation is 1.4. When 3 LED devices are defective, the average is 70.5, and the standard deviation is 2.1 (refer to Table 1 below).

As a result, the ladder network LED driving circuit, shown in FIG. 4, according to the related art may fail when processing defects occur during the manufacturing process. On the other hand, the ladder network LED driving circuit according to this embodiment, as shown in FIG. 6, may pass. Accordingly, manufacturing yield can be increased.

In Table 1, the average operation number and the standard deviation of each of the ladder network LED driving circuit according to the related art (FIG. 4) and the ladder network LED driving circuit (FIG. 6) according to the embodiment of the invention are shown according to the number of LED devices, which break down, that is, the number of defects in any one of the first and second branch sequences.

TABLE 1

| | Ladder network circuit before improvement (FIG. 4) | | | | | Ladder network circuit of present invention (FIG. 6) | | | | |
|---|---|---|---|---|---|---|---|---|---|---|
| classification Number of defects | Forward operation number | reverse operation number | Average operation number | Standard deviation | Reduction rate (%) | Forward operation number | Reverse operation number | Average operation number | standard deviation | Reduction rate (%) |
| 0 | 75 | 75 | 75 | 0 | 100 | 72 | 72 | 72 | 0 | 100 |
| 1 | 72 | 74 | 73 | 1.4 | 97 | 72 | 71 | 71.5 | 0.7 | 99 |
| 2 | 69 | 73 | 71 | 2.8 | 95 | 72 | 70 | 71 | 1.4 | 99 |
| 3 | 66 | 72 | 69 | 4.2 | 92 | 72 | 69 | 70.5 | 2.1 | 98 |

TABLE 1-continued

| | Ladder network circuit before improvement (FIG. 4) | | | | | Ladder network circuit of present invention (FIG. 6) | | | | |
|---|---|---|---|---|---|---|---|---|---|---|
| classification Number of defects | Forward operation number | reverse operation number | Average operation number | Standard deviation | Reduction rate (%) | Forward operation number | Reverse operation number | Average operation number | standard deviation | Reduction rate (%) |
| 4 | 63 | 71 | 67 | 5.6 | 89 | 72 | 68 | 70 | 2.8 | 97 |
| 5 | 60 | 70 | 65 | 7.0 | 87 | 72 | 67 | 69.5 | 3.5 | 97 |

As shown in Table 1, the ladder network LED driving circuit according to the embodiment of the invention has a reduction rate of operating LEDs that is lower than that of the ladder network LED driving circuit according to the related art. Therefore, when a ratio of 97% compared with a normal operation in a manufacturing process is determined as "fail", the ladder network LED driving circuit according to the related art is determined as fail if one LED device is defective. On the other hand, even when the ladder network LED driving circuit according to the embodiment of the invention has up to five defective LED devices, the ladder network LED driving circuit can be determined as "pass". Further, even though the LED devices of the LED chip sequentially break down due to various kinds of factors, such as a surge voltage or power noise that may occur during the operation, the maximum life of the LED chip can be ensured since the LED chip has a small variation.

As set forth above, according to exemplary embodiments of the invention, ESD characteristics can be improved by controlling the number of LED devices at a predetermined position in a ladder LED driving circuit in which a ratio of the number of LED devices, which are always turned on, to the total number of LED devices is increased. Further, even when a predetermined LED device breaks down during the operation, due to a predetermined factor, such as a surge voltage or power noise, the rest of LEDs undergo a small variation at an alternating voltage. Therefore, a reduction in LED life can be prevented.

While the present invention has been shown and described in connection with the exemplary embodiments, it will be apparent to those skilled in the art that modifications and variations can be made without departing from the spirit and scope of the invention as defined by the appended claims.

What is claimed is:

1. An LED driving circuit comprising:

at least one ladder circuit comprising:

(n−1) number (here, n is a positive integer satisfying n≧2) of first branches provided between first and second junction points, and connected in-line with each other by n number of first middle junction points, (n−1) number of second branches arranged in parallel with the first branches, and connected in-line with each other by n number of second middle junction points between the first and second junction points, and n number of middle branches connecting m-th first and second middle junction points to each other, wherein at least one LED device is disposed on each of the first, second, and middle branches, and m is a positive integer defining respective sequences of the (n−1) number of first branches, the (n−1) number second branches, and the n number of middle branches from the first junction point;

a first current loop having a first group of LED devices located on a sequence of 2m first branches, a sequence of (2m−1) second branches, and the n number of middle branches, respectively to be connected in series with each other and driven in a first half cycle of an alternating voltage applied between the first and second junction points; and a second current loop having a second group of LED devices located on a sequence of (2m−1) first branches, a sequence of 2m second branches, and the n number of middle branches, respectively to be connected in series with each other and driven in a second half cycle of the alternating voltage between the first and second junction points, wherein the number of LED devices included in each of the first and second branches is greater than the number of LED devices included in each of the middle branches.

2. The LED driving circuit of claim 1, wherein two LEDs are included in each of the first and second branches, and one LED device is included in each of the middle branches.

3. An LED array device comprising a plurality of LED devices included in the LED driving circuit of claim 2.

4. An LED array device comprising a plurality of LED devices included in the LED driving circuit of claim 1.

* * * * *